United States Patent [19]

Howe et al.

[11] Patent Number: 4,509,444

[45] Date of Patent: Apr. 9, 1985

[54] FOOT LEVELING SEWING AID AND METHOD OF USE

[75] Inventors: Clarice M. Howe, Westfield; Audrey Mack, Colonia, both of N.J.

[73] Assignee: The Singer Company, Stamford, Conn.

[21] Appl. No.: 488,937

[22] Filed: Apr. 27, 1983

[51] Int. Cl.[3] ..... D05B 35/00

[52] U.S. Cl. ..... 112/262.1; 112/153

[58] Field of Search ..... 281/15, 29; 33/168 R; 402/14; 112/262.1, 151, 153

[56] References Cited

U.S. PATENT DOCUMENTS

| | | | |
|---|---|---|---|
| 987,703 | 3/1911 | Curtin | 33/168 R |
| 1,061,090 | 5/1913 | Levy . | |
| 2,317,614 | 4/1943 | Johnston . | |
| 2,478,073 | 8/1949 | Antonelli . | |
| 3,401,658 | 9/1968 | Kirby | 112/153 |
| 4,244,603 | 1/1981 | DeMonti | 281/29 |

FOREIGN PATENT DOCUMENTS

| | | | |
|---|---|---|---|
| 1135192 | 4/1957 | France | 33/168 R |

*Primary Examiner*—Werner H. Schroeder
*Assistant Examiner*—Andrew M. Falk
*Attorney, Agent, or Firm*—William V. Ebs; Robert E. Smith; Edward L. Bell

[57] ABSTRACT

A plurality of like fabric layers, each of which is formed with a concavely curved edge, a convexly curved edge, and a straight edge, are held together at one end with a metal grommet. A selected edge and selected numbers of layers are disposed under a presser foot against a thickened edge of material to be sewn to support and maintain the presser foot level, and to thereby prevent stitch shortening.

3 Claims, 6 Drawing Figures

FOOT LEVELING SEWING AID AND METHOD OF USE

BACKGROUND OF THE INVENTION

1. Field of the Invention

The invention relates to sewing aids for use by the operator of a sewing machine.

2. Description of the Prior Art

It has been found when sewing a many plied portion of fabric along a stitch line permitting only a portion of the presser foot of the machine to extend over the multiple plies that the presser foot is prevented from applying downward force evenly to the fabric, and that the fabric will slip on the feed dog of the machine causing shorter stitches to be sewn than those selected by the operator.

It is a primary object of the present invention to provide a sewing aid which a machine operator can use to prevent the shortening of stitches when sewing a many plied portion of fabric along a stitch line as described.

It is another object of the invention to provide a sewing aid which a machine operator can use to support a presser foot portion overhanging a many plied portion of a fabric regardless of the thickness of such fabric portion.

It is also an object of the invention to provide a sewing aid as described which can be easily and inexpensively constructed with readily available materials.

Other objects and advantages of the invention will become apparent during a reading of the specification taken in connection with the accompanying drawings.

SUMMARY OF THE INVENTION

A sewing aid in accordance with the invention includes a number of layers of a supple material which is preferably cloth. The layers are correspondingly shaped, and each is formed with at least one straight edge and at least one curved edge. Preferably, each layer includes a straight edge, a convexly curved edge and a concavely curved edge. The layers are held together at a location about which at least portions of a chosen number of layers can be disposed relative to the other layers to expose a selected thickness of material consisting of the other layers and a selected type of edge for use under the presser foot of a sewing machine adjacent an edge of a multiple portion of a fabric workpiece.

DESCRIPTION OF THE PREFERRED EMBODIMENT OF THE INVENTION

Figure 1:
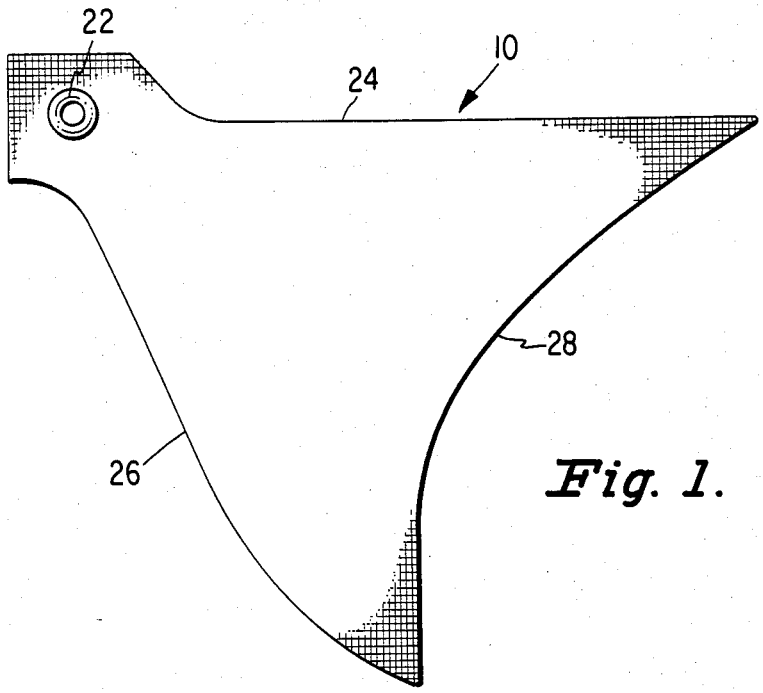
FIG. 1 is a top plan view of the sewing aid of the invention.
Figure 2:
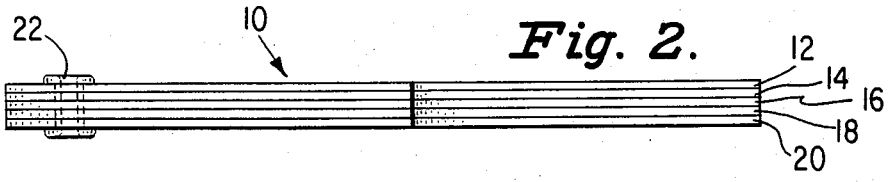
FIG. 2 is an edge view.
Figure 3:
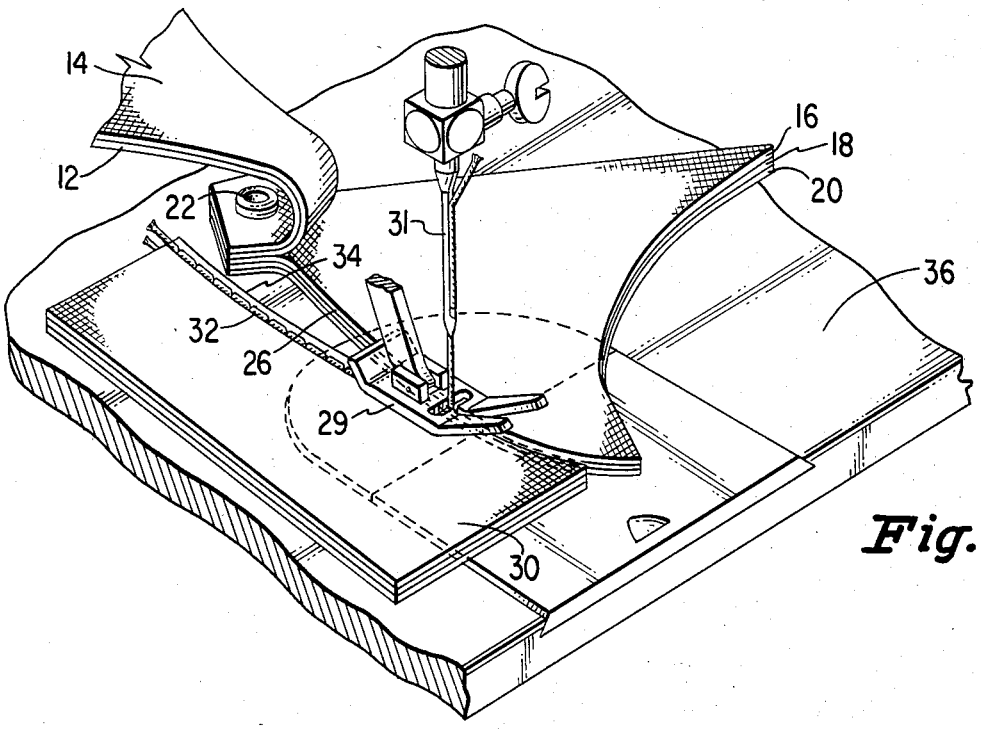
FIG. 3 is a perspective view showing the aid in use during the edge stitching of a workpiece along a concave curve.

Referring to the drawings, and in particular to FIGS. 1, 2 and 3 thereof, there may be seen a sewing aid 10 according to the invention including a number of cloth layers 12, 14, 16, 18 and 20 which are held together at one end of the aid with a metal grommet 22, and which are alike in shape and thickness. As shown, each layer is formed with a straight edge 24, a convexly curved edge 26 and a concavely curved edge 28. One or more of the cloth layers may be folded about grommet 22 to expose a thickness of material consisting of the other layers for use under the presser foot 29 of a sewing machine, as for example, in the manner depicted in FIG. 3 wherein there is shown a multi-plied fabric workpiece 30 requiring stitches along a line 32 in close proximity to a concavely curved edge 34.

The stitches along a line such as line 32 in a multi-plied fabric must be sewn with the fabric workpiece extending only part way under the presser foot because of the proximity of the stitch line to the edge of the fabric, and in the past when such an operation was attempted without benefit of the sewing aid of the invention, the fabric would tend to slip on the feed dog of the machine (not shown in the drawing) and shorter stitches would result. An operator uses the sewing aid 10 to prevent such result by folding back about grommet 22 the number layers (12 and 14 in FIG. 3) of cloth needed to expose a combined thickness of the other layers (16, 18 and 20) substantially matching the thickness of fabric 30 which has been disposed under the presser foot for penetration by a neeedle 31 on the stitch line. The exposed layers are then disposed so as to locate a portion of the convexly curved edges 26 under the presser foot 29 closely adjacent to or abutting the fabric edge 34, and so as to have the edges 26 match as nearly as possible the curvature of edge 34 under the foot. Presser foot 29 may be understood to be of a conventional type which, as is customary, is spring biased downwardly toward the bed 36 of a machine, but can be raised at will by an operator. The foot is of course, raised during the positioning of fabric 30 and the sewing aid layers under the foot, and is lowered when a sewing operation is to be initiated. The fabric 30 is sewn along line 32, while the sewing aid and fabric 30 are fed under the presser foot by the feed dog of the machine. At the same time, an operator manipulates the fabric to enable the needle to follow the stitch line, and the sewing aid to maintain the relationship initially established under the presser foot between the fabric edge 34 and sewing aid edges 26.

Figure 4:
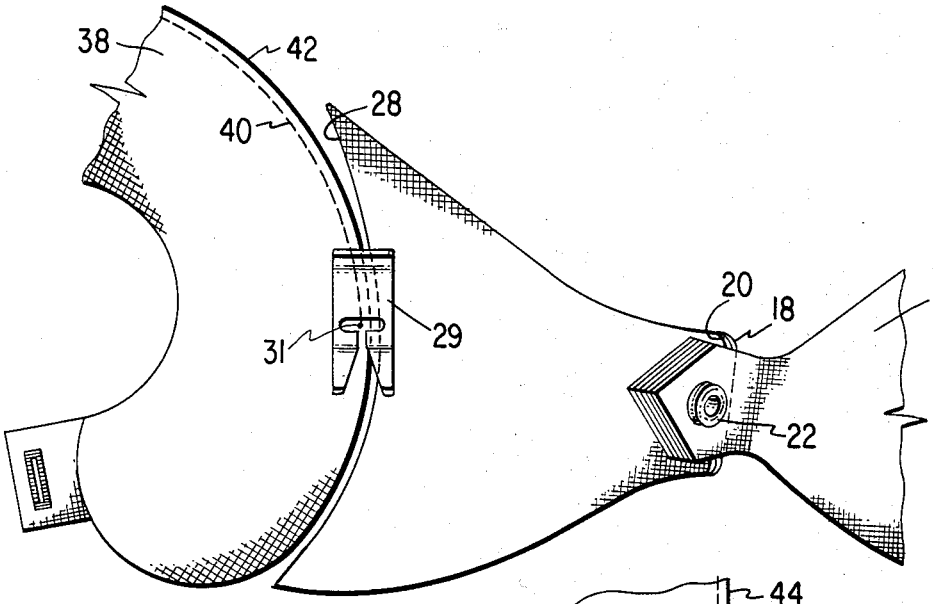
FIG. 4 is a somewhat diagrammatic plan view illustrating use of the aid during the edge stitching of a workpiece along a convex curve.

The sewing aid 10 is used in a similar manner to that already described to control the formation of stitches in a multi-plied fabric 38 as shown in FIG. 4, along a stitch line 40 in close proximity to a convexly curved edge 42, except that concavely curved edges 28 of a selected number of layers of the feeding aid according to the thickness of the fabric are disposed and maintained alongside the curved edge 42 of the fabric under the presser foot 29. Concavely curved edges 28 of the sewing aid may also be used to advantage when collar points are sewn. During such an operation, only a small part of the presser foot can extend over the collar, however, the concavely curved edges 28 are then used under the presser foot adjacent the collar point in positions such as to underlie as much of the remaining portion of the presser foot as possible and so provide needed support for the presser foot.

Figure 5:
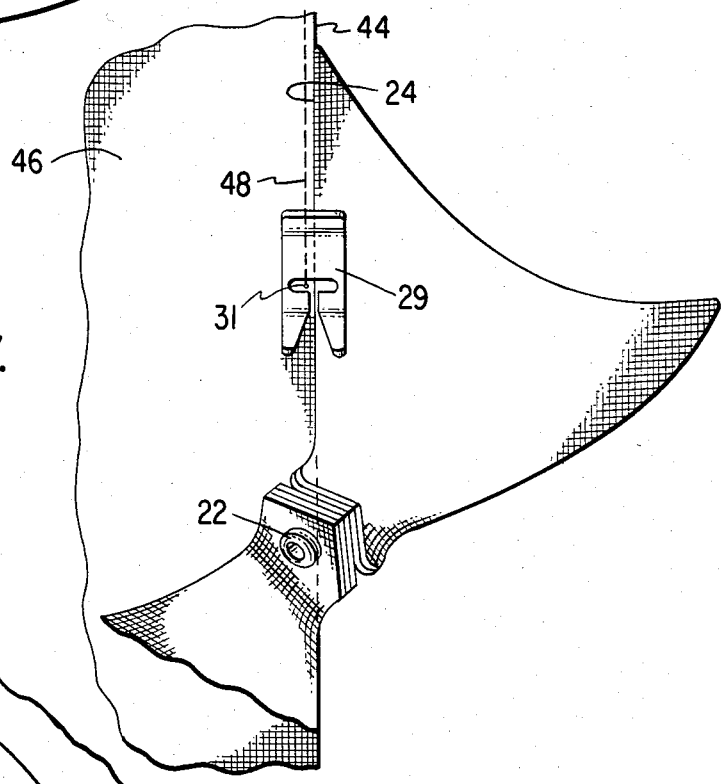
FIG. 5 is a somewhat diagrammatic plan view illustrating use of the aid during the edge stitching of a straight seam; and, FIG. 6 is a somewhat diagrammatic plan view illustrating use of the aid when climbing a hurdle in a workpiece.
Figure 6:
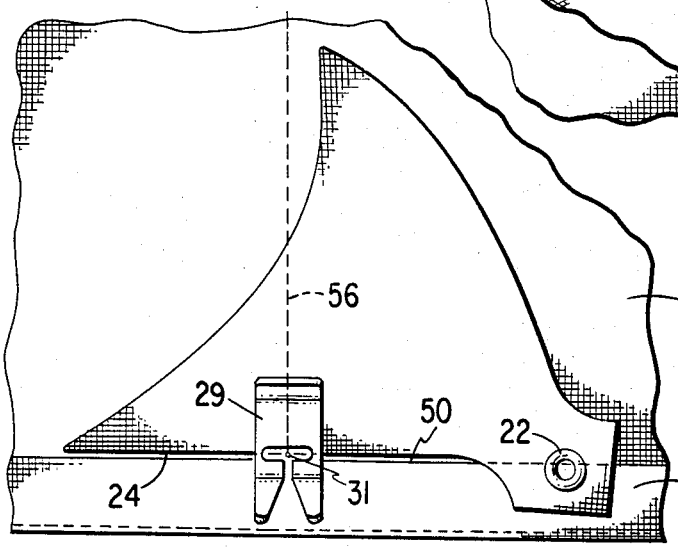

Straight edges 24 are used under the presser foot 24 opposite the straight edge 44 of a multi-plied fabric 46 (see FIG. 5) when sewing along a stitch line 48 in close proximity to edge 44. Straight edges 24 are also used under the presser foot opposite a straight edge 50 FIG. 6 defined by a fold 52 of a plurality of layers of a fabric 54 when stitches are to be sewn across the fold and the presser foot must therefor climb the hurdle at edge 50 of the fabric.

In general, the sewing aid 10 may be used to advantage under the presser foot of a sewing machine whenever only a portion of the presser foot can extend over a workpiece during a sewing operation. The sewing aid then lends support to the presser foot, resists any tendency of the foot to tilt and results in even pressure being applied to the workpiece by the foot such that the workpiece is fed under the sewing needle and presser foot without slipping on the feed dog of the machine.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such alterations and modifications which do not depart from the spirit and scope of the invention are intended to be included within the scope of the appended claims.

I claim:

1. A method of sewing stitches in multiple plies of fabric on a sewing machine along a line permitting only a portion of the presser foot of the machine to extend over the multiple plies during a sewing operation, the said method comprising disposing the multiple plies under a portion of the presser foot in a position providing for penetration of the multiple plies by the needle of the machine in said line, selecting one or more layers of material to provide a combined thickness thereof substantially corresponding to the combined thickness of the multiple plies, disposing the selected material under the presser foot of the machine in a position adjacent to the multiple plies, lowering the presser foot to cause the foot to engage the multiple plies as well as said material and press both against the feed dog of the machine for movement thereby, and sewing the multiple plies with the machine along said line while maintaining the said material adjacent the multiple plies.

2. A method according to claim 1 in which only layers of material with edges that can be matched to the edge of fabric plies under the presser foot are selected for use, and the said layers are disposed with matching edge portions thereof adjacent edges of the fabric plies under the foot.

3. A method according to claim 2 in which the selected layers are disposed under the presser foot in an abutting relationship with the multiple plies of fabric.

* * * * *